US008215755B2

(12) United States Patent
Iwamura et al.

(10) Patent No.: US 8,215,755 B2
(45) Date of Patent: Jul. 10, 2012

(54) LIQUID SUPPLY APPARATUSES AND LIQUID CONTAINERS

(75) Inventors: Yuko Iwamura, Nagoya (JP); Hirofumi Kondo, Tajimi (JP); Hitomi Sadohara, Nagoya (JP); Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 344 days.

(21) Appl. No.: 12/579,373

(22) Filed: Oct. 14, 2009

(65) Prior Publication Data

US 2010/0110154 A1 May 6, 2010

(30) Foreign Application Priority Data

Oct. 30, 2008 (JP) ..... 2008-279552

(51) Int. Cl.
*B41J 2/175* (2006.01)

(52) U.S. Cl. ..... 347/86; 347/85

(58) Field of Classification Search ..... 347/7, 53, 347/85, 86, 87, 49
See application file for complete search history.

(56) References Cited

U.S. PATENT DOCUMENTS

| | | | | |
|---|---|---|---|---|
| 6,502,933 | B2 * | 1/2003 | Lim et al. | 347/86 |
| 6,623,092 | B2 | 9/2003 | Kim et al. | |
| 6,733,114 | B2 * | 5/2004 | Kobayashi et al. | 347/85 |

FOREIGN PATENT DOCUMENTS

| | | | |
|---|---|---|---|
| JP | H03-042528 | U | 4/1991 |
| JP | 2003-063030 | A | 3/2005 |
| JP | 2005-145126 | A | 6/2005 |
| JP | 2008-087159 | A | 4/2008 |

* cited by examiner

*Primary Examiner* — Anh T. N. Vo
(74) *Attorney, Agent, or Firm* — Baker Botts L.L.P.

(57) ABSTRACT

A liquid supply apparatus includes a container mounting portion and a liquid container. The liquid container includes a case configured to store liquid therein, and a movable member positioned in the case. The movable member and the case comprise a pair of magnetic materials on which a magnetic force acts, such that the pair of magnetic materials attracts each other. When the liquid container is not mounted to the container mounting portion, the movable member is in a fixed state in which the movable member is fixed to the case by the magnetic force acting between the pair of magnetic materials. The container mounting portion includes a release member configured to release the movable member from the fixed state by generating a magnetic force acting between the pair of magnetic materials, such that the pair of magnetic materials separates away from each other.

10 Claims, 9 Drawing Sheets

LIQUID SUPPLY APPARATUSES AND LIQUID CONTAINERS

CROSS-REFERENCE TO RELATED APPLICATION

The present application claims priority from Japanese Patent Application No. JP-2008-279552, which was filed on Oct. 30, 2008, the disclosure of which is incorporated herein by reference in its entirety.

BACKGROUND OF THE INVENTION

1. Field of the Invention

The present invention relates to liquid supply apparatuses and liquid containers.

2. Description of Related Art

A known liquid container, e.g., a liquid cartridge is configured to be removably mounted to a container mounting portion provided in an apparatus such as an ink jet printer. The known liquid container has a movable member, such as a float, which is configured to move according to the change of the liquid level in the container. By detecting the position of the movable member, the liquid amount (liquid level) in the container can be determined.

For example, a known ink cartridge such as an ink cartridge described in JP-A-2008-087159 is configured to be removably mounted to a cartridge mounting portion of an ink-jet printer. The ink cartridge has an arm having a float and a light-blocking panel at both ends thereof. The amount of ink stored in the ink cartridge can be determined by detecting the position of the light-blocking panel when the float moves up and down according to the change of the ink level in the cartridge. Such a detection is performed by an optical sensor provided at the cartridge mounting portion.

In the liquid container having the movable member such as the float as described above, when the movable member moves greatly due to the fluctuation of the liquid surface caused by vibrations applied from the outside of the container when the container is not in use, e.g., when the container is transported, the movable member or the interior of the container may be damaged. Moreover, when bubbles are formed in the liquid container by the movement of the movable member, and the liquid container is used with the bubbles formed therein, the movement of the movable member may be blocked by the bubbles, and the liquid amount in the container cannot be determined accurately. Therefore, in another known liquid container, the movable member is fixed to a case of the container when the liquid container is not used.

For example, a fuel tank such as a fuel tank described in JP-A-2005-145126, stores fuel for an automotive vehicle and has a float configured to be detected for determining the amount of fuel in the tank. This fuel tank has a stopper configured to restrict the movement of the float, and a string connected to the stopper. The movement of the float is restricted by the stopper when the fuel tank is transported, and the float is released from the restriction when the stopper is removed by pulling the string.

The stopper is configured to restrict the movement of the float by directly contacting the float, and the string is connected to the stopper such that the stopper can be removed from the outside of the tank when the tank is used. However, when the string is pulled from the outside of the tank, the float may be damaged because a force to pull the string may be applied heavily to the float, or the stopper may come into contact with and hence damage the interior of the tank before being removed out of the tank. Therefore, an attention should be paid not to cause the damage when the stopper is removed.

SUMMARY OF THE INVENTION

Therefore, a need has arisen for liquid supply apparatuses and liquid containers which at least reduce these and other shortcomings of the related art. A technical advantage of the present invention is that a movable member, which is configured to move according to an amount of liquid stored in a case, can be fixed indirectly to the case using a magnetic force.

According to an embodiment of the present invention, a liquid supply apparatus comprises a container mounting portion and a liquid container configured to be removably mounted to the container mounting portion. The liquid container comprises a case configured to store liquid therein, and a movable member positioned in the case and configured to move relative to the case according to an amount of liquid stored in the case. The movable member and the case comprise a pair of magnetic materials on which a magnetic force acts, such that the pair of magnetic materials attracts each other. When the liquid container is not mounted to the container mounting portion, the movable member is in a fixed state in which the movable member is fixed to the case by the magnetic force acting between the pair of magnetic materials. The container mounting portion comprises a release member configured to release the movable member from the fixed state by generating a magnetic force acting between the pair of magnetic materials, such that the pair of magnetic materials separates away from each other, when the liquid container is mounted to the container mounting portion.

According to another embodiment of the present invention, a liquid container, comprises a case configured to store liquid therein, and a movable member positioned in the case and configured to move relative to the case according to an amount of liquid stored in the case. The movable member and the case comprise a pair of magnetic materials on which a magnetic force acts, such that the pair of magnetic materials attracts each other. The movable member is in a fixed state in which the movable member is fixed to the case by the magnetic force acting between the pair of magnetic materials.

Other objects, features, and advantages of embodiments of the present invention will be apparent to persons of ordinary skill in the art from the following description of preferred embodiments with reference to the accompanying drawings.

BRIEF DESCRIPTION OF DRAWINGS

For a more complete understanding of the present invention, the needs satisfied thereby, and the objects, features, and advantages thereof, reference now is made to the following description taken in connection with the accompanying drawings.

DETAILED DESCRIPTION OF EMBODIMENTS

Embodiments of the present invention and their features and technical advantages may be understood by referring to FIGS. 1-9, like numerals being used for like corresponding portions in the various drawings.

Figure 1:
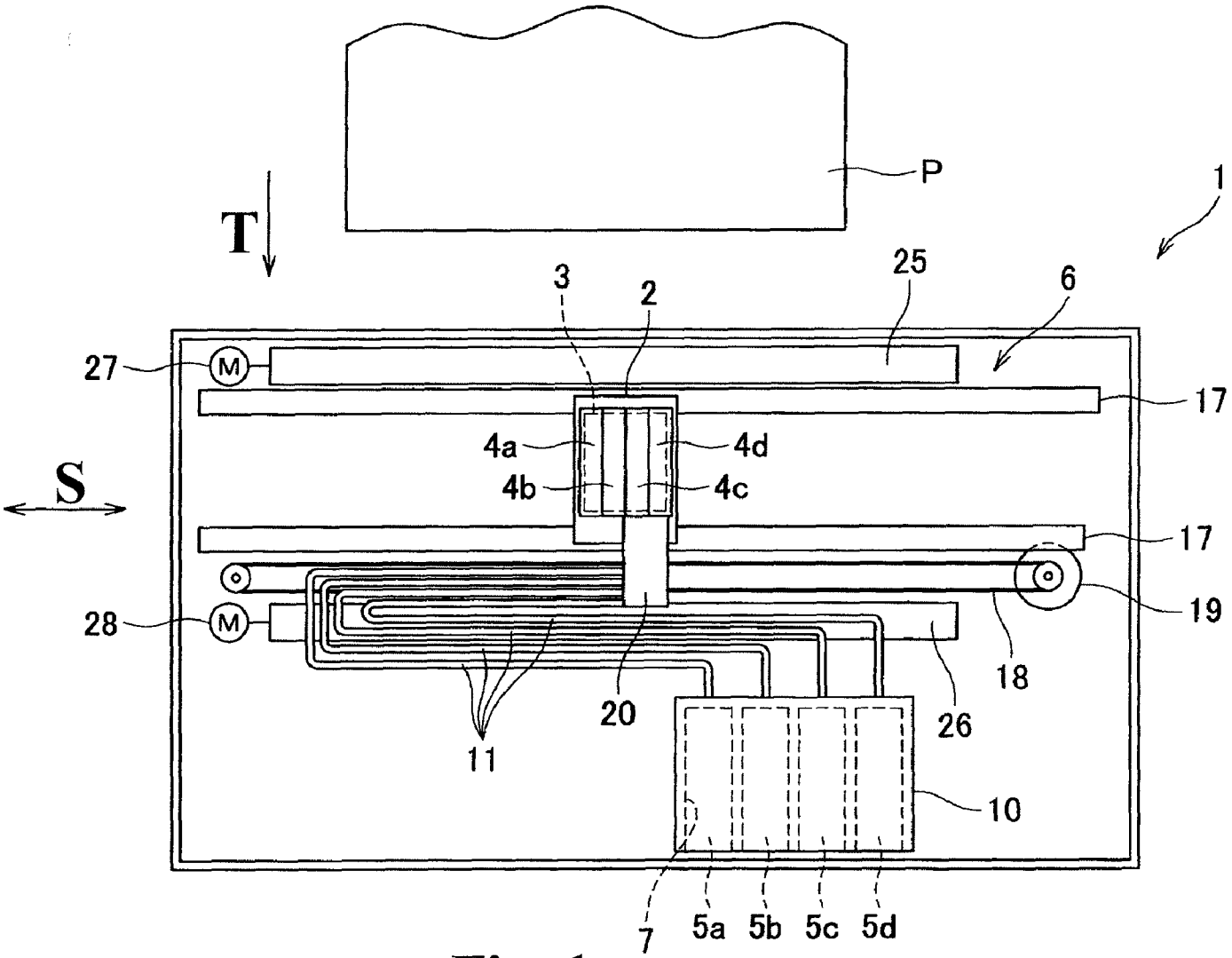
FIG. 1 is a schematic view of an ink-jet printer according to an embodiment of the present invention.

Referring to FIG. 1, an ink-jet printer 1 may comprise a carriage 2 configured to be reciprocate along a scanning direction S, an ink-jet head 3 and four sub tanks 4*a* to 4*d* mounted on the carriage 2, four ink cartridges 5*a* to 5*d* as an example of liquid containers, a holder 10 comprising four cartridge mounting portions 7 as an example of container mounting portions, to which the four ink cartridges 5*a* to 5*d* are mounted, respectively, and a transporting device 6 configured to transport a sheet of paper P in a paper transporting direction T. Four ink cartridges 5*a* to 5*d* and four cartridge mounting portions 7 may be an example of liquid supply apparatuses.

The carriage 2 may be configured to reciprocate along two guide shafts 17 extending in the scanning direction S. An endless belt 18 may be connected to the carriage 2, and the carriage 2 may be configured to move in the scanning direction S in association with the travel of the endless belt 18 when the endless belt 18 is driven to travel by a carriage drive motor 19.

The ink-jet head 3 and the four sub tanks 4*a* to 4*d* may be mounted on the carriage 2. The ink jet head 3 may comprise nozzles in its lower surface. The four sub tanks 4*a* to 4*d* may be aligned in the scanning direction S, and a tube joint 20 is integrally provided on the four sub tanks 4*a* to 4*d*. The four sub tanks 4*a* to 4*d* and the four ink cartridges 5*a* to 5*d* may be in fluid communication via flexible tubes 11 connected to the tube joint 20.

The holder 10 may comprise four cartridge mounting portions 7 aligned in the scanning direction S, and the four ink cartridges 5*a* to 5*d* may be configured to removably mounted to the four cartridge mounting portions 7, respectively. The four ink cartridges 5*a* to 5*d* may contain inks in four colors of black, yellow, cyan, and magenta, respectively.

The inks in four colors stored in the four ink cartridges 5*a* to 5*d* may be supplied to the four sub tanks 4*a* to 4*d*, respectively, via the four tubes 11 connected to the holder 10, and may be stored temporarily in the sub tanks 4*a* to 4*d*, and then may be supplied to the ink-jet head 3. The ink jet head 3 may reciprocate in the scanning direction S together with the carriage 2 and eject ink droplets onto the sheet of paper P transported by the transporting device 6 from the nozzles provided in the lower surface thereof.

The transporting device 6 may comprise a paper feeding roller 25 positioned on the upstream side of the ink-jet head 3 with respect to the paper transporting direction T, and a paper discharging roller 26 positioned on the downstream side of the ink-jet head 3 with respect to the paper transporting direction T. The paper feeding roller 25 and the paper discharging roller 26 may be driven to rotate by a paper feeding motor 27 and a paper discharging motor 28, respectively. The transporting device 6 may be configured to feed the sheet of paper P to underneath the ink-jet head 3 from the upstream side by the paper feeding roller 25, and discharge the sheet of paper P, on which an image or characters are printed by the ink-jet head 3, to the downstream side by the paper discharging roller 26.

Figure 2:
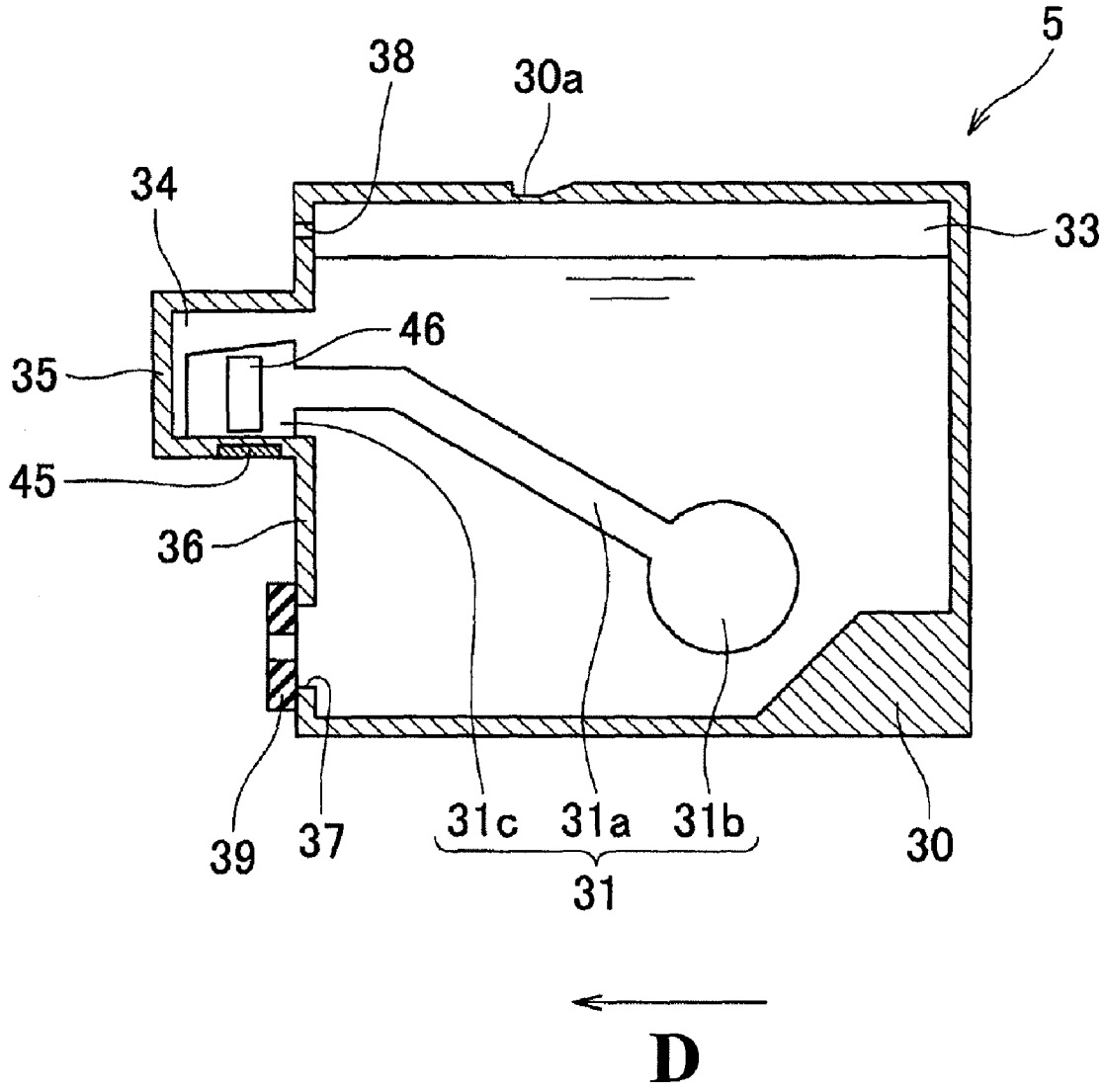
FIG. 2 is a cross-sectional view of an ink cartridge according to an embodiment of the present invention

Because the four ink cartridges 5*a* to 5*d* storing the inks in four colors respectively have the same configuration, one of them will be described in the following with a reference numeral 5. FIG. 2 is a cross-sectional view of the ink cartridge 5 taken along a plane including a mounting direction D along which the ink cartridge 5 is mounted to the cartridge mounting portion 7. In the following, "front" means "front" with respect to the mounting direction D, and "rear" or "back" means "rear" or "back" with respect to the mounting direction D.

Referring to FIG. 2, the ink cartridge 5 may comprise a case 30 configured to store ink therein, and the case 30 may have an ink supply opening 37 formed through a front wall 36 of the case 30, a pivotable member 31 positioned in the case 30, such that it can be determined whether or not a predetermined amount or more of ink is stored in the case 30.

The case 30 may comprise a translucent material, e.g., a transparent or semi-transparent material, such as synthetic resin or the like, such that light, e.g., visible or infrared light can pass therethrough. The case 30 may have a substantially rectangular parallelepiped shape. The case 30 may comprise an ink chamber 33 formed therein, and the ink chamber 33 is configured to store ink therein. The case 30 may comprise a projecting portion 35 projecting forwardly from the front wall 36. The projecting portion 35 may have a sensor chamber 34 formed therein, and the sensor chamber 34 may be in fluid communication with the ink chamber 33. A light blocking panel 31*c* of the pivotable member 31, descried below, may be positioned in the sensor chamber 34 of the projecting portion 35.

The ink supply opening 37 may be formed through a lower portion of the front wall 36 of the case 30, and the ink supply opening 37 may be in fluid communicating with a lower portion of the ink chamber 33, such that ink is supplied from the ink chamber 33 to the outside of the case 30 via the ink supply opening 37. An annular sealing member 39 formed of rubber or the like may be attached to a portion of the front wall 36 surrounding the ink supply opening 37. Moreover, an air communication opening 38 may be formed through an upper portion of the front wall 36, and the air communication opening 38 may be in fluid communication with an upper portion of the ink chamber 33, such that air is introduced into the ink chamber 33 from the outside of the case 30 via the air communication opening 38. An engaging depressed portion 30*a* may be formed in an upper outer surface of the case 30. A locking member 55 provided at the cartridge mounting portion 7 (see FIG. 3) may engage the engaging depressed portion 30*a* when the ink cartridge 5 is mounted to the cartridge mounting portion 7.

The pivotable member 31 may comprise an arm 31*a* pivotably supported by the case 30 in the ink chamber 33, a float

31*b* connected to one end of the arm 31*a*, and the light blocking panel 31*c*, as an example of the movable member, connected to the other end of the arm 31*a* opposite to the float 31*b*. The float 31*b* may be configured to move up and down according to the change of the ink level in the case 30. The light blocking panel 31*c* may be stored in the sensor chamber 34 of the projecting portion 35, and may be configured to be able to block light emitted from an optical sensor 53 (see FIG. 3) provided at the cartridge mounting portion 7 when the ink cartridge 5 is mounted to the cartridge mounting portion 7 of the holder 10. For example, the light blocking panel 31*c* may be configured to prevent at least a portion of the light from passing therethough or may be configured to alter the path of at least a portion of the light.

The pivotable member 31 may be configured to pivot such that the light blocking panel 31*c* connected to the float 31*b* via the arm 31*a* moves up and down relative to the case 30 in the sensor chamber 34 when the float 31*b* moves up and down according to the change of the ink level in the ink chamber 33. More specifically, when a sufficient amount of ink is stored in the ink chamber 33, large buoyancy may act on the float 31*b*, and a moment in the counterclockwise direction in FIG. 2 may be applied to the arm 31*a*, such that the light blocking panel 31*c* comes into contact with the bottom surface of the sensor chamber 34 In contrast, when the amount of ink in the ink chamber 33 decreases and the float 31*b* is partly exposed from the ink surface, the buoyancy acting on the float 31*b* may decrease, such that the buoyancy and the gravity acting on the float 31*b* balance out. When the amount of ink in the ink chamber 33 further decreases, the float 31*b* may move down following the lowering ink level, such that the arm 31*a* pivots clockwise in FIG. 2, and the light blocking panel 31*c* comes into contact with the top surface of the sensor chamber 34.

In other words, the light blocking panel 31*c* may be configured to move relative to the case 30 according to the movement of the float 31*b* when the float 31*b* moves up and down due to the movement of the ink level in the case 30, therefore the light blocking panel 31*c* may be an example of the movable member.

The ink cartridge 5 may comprise a mechanism for immovably fixing the pivotable member 31, which is configured to pivot in the ink chamber 33, to the case 30 when the ink cartridge 5 is not mounted to the cartridge mounting portion 7 of the holder 10

More specifically, the light blocking panel 31*c* of the pivotable member 31 may comprise a permanent magnet 46. A metal piece 45 made of a soft magnetic material may be provided at a bottom wall of the projecting portion 35 of the case 30 at a position directly below the light blocking panel 31*c*. Among magnetic materials, the soft magnetic material is a material in which magnetic poles vanish or are inverted relatively easily. In other words, the soft magnetic material is magnetized relatively easily by a magnetic field of a permanent magnet to generate a magnetic force which causes the soft magnetic material and the permanent magnet to attract each other, and the magnetic poles in the soft magnetic member vanish when the magnetic field of the permanent magnet does not reach the soft magnetic material so as not to generate a magnetic field by itself. A magnetic force may act on the metal piece 45 provided at the bottom wall of the projecting portion 35 and the permanent magnet 46 of the light blocking panel 31*c*, such that the metal piece 45 and the permanent magnet 46 attract each other. The light blocking panel 31*c* may be immovably fixed to the case 30 by the magnetic force acting between the metal piece 45 and the permanent magnet 46 in a lower end position of the movable range of the light blocking panel 31*c*, i.e., in a position where the light blocking panel 31*c* contacts the bottom surface of the sensor chamber 34 when the amount of ink in the ink chamber 33 is large.

In another embodiment, the light blocking panel 31*c* may be fixed in an upper end position of the movable range of the light blocking panel 31*c*, i.e., in a position where the light blocking panel 31*c* contacts the top surface of the sensor chamber 34 when the amount of ink in the ink chamber 33 is small. Nevertheless, because the blocking panel 31*c* is fixed in the lower end position in this embodiment as described above, in the ink cartridge 5 having a large amount of ink stored therein, not only the magnetic force between the permanent magnet 46 and the metal piece 45, but also the buoyancy acting on the float 31*b* of the pivotable member 31 may work as a force to press the light blocking panel 31*c* to the bottom surface of the sensor chamber 34. Therefore, in the lower limit position, the light blocking panel 31*c* can be fixed firmly without resisting against the buoyancy acting on the float 31*b*. Therefore, the light blocking panel 31*c* cannot be easily released from a fixed state in which the light blocking panel 31*c* is immovably fixed to the case 30, even if the ink cartridge 5 vibrates when the carriage 2 moves or the transporting device 6 operates, or when the printer 1 is moved. As such, the pivotable member 31 may be prevented from being damaged, and bubbles may be prevented from being formed in the ink chamber 33.

Referring to FIG. 1, the holder 10 may comprise the four cartridge mounting portions 7 aligned in the scanning direction S. Because the four cartridge mounting portions 7 have the same configuration, one of them will be described in the following.

Figure 3A:
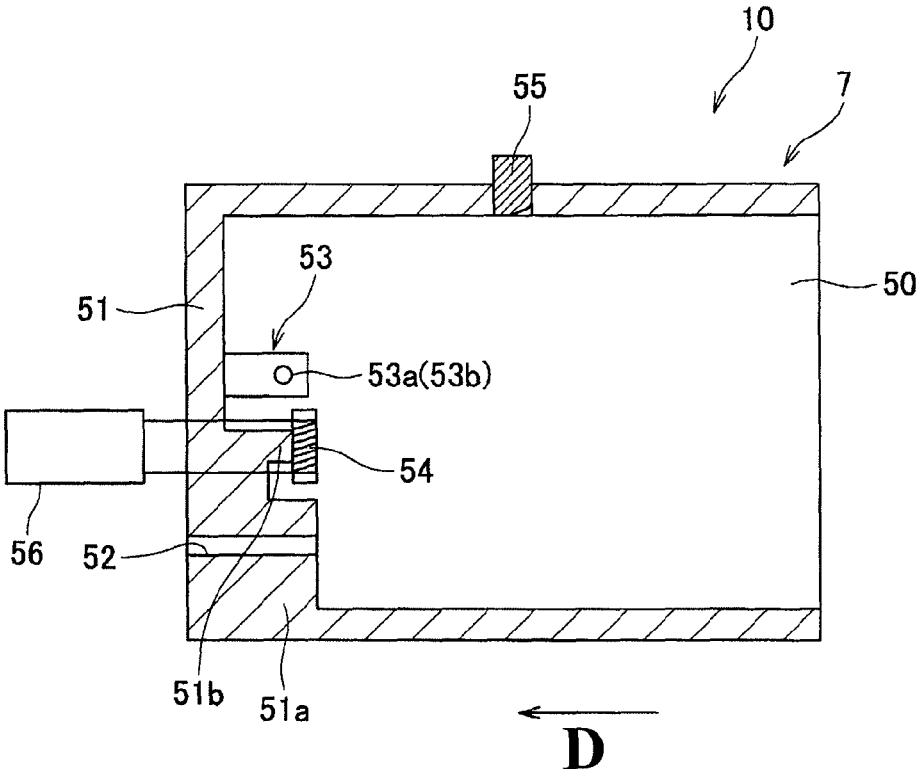
FIG. 3(A) is a cross-sectional view of a holder in which the ink cartridge of FIG. 2 is not mounted to a cartridge mounting portion of the holder.

Referring to FIG. 3(A), the cartridge mounting portion 7 may comprise a cartridge storage chamber 50 which is opened backward, a front wall 51 positioned opposite to the opening of the cartridge storage chamber 50 with respect to the mounting direction D, an ink supply channel 52 formed through the front wall 51, the optical sensor 53 provided on the front wall 51, and an electromagnet 54 provided on the front wall 51.

The ink cartridge 5 may be inserted into the cartridge storage chamber 50 via the opening of the cartridge storage chamber 50. A lower portion of the front wall 51 may comprise a protruding portion 51*a* which protrudes backward relative to an upper portion of the front wall 51. The ink supply channel 52 may be formed through the protruding portion 51*a*. The ink supply channel 52 may be in fluid communication with the ink-jet head 3 via the tube 11 shown in FIG. 1. The locking member 55 may be provided in an upper wall of the cartridge mounting portion 7, such that the locking member 55 may move up and down. The locking member 55 may be configured to engage the engaging depressed portion 30*a* of the ink cartridge 5 mounted in the cartridge storage chamber 50.

The optical sensor 53 may be provided at a center portion of the front wall 51 with respect to the gravitational direction, and may comprise a light-emitting portion 53*a* and a light-receiving portion 53*b* aligned in a horizontal direction which is perpendicular to the mounting direction D. The light-emitting portion 53*a* and the light-receiving portion 53*b* may face each other separated at a predetermined distance. The front wall 51 may comprise a supporting portion 51*b* which protrudes backward below the optical sensor 53, and the electromagnet 54 may be supported at a distal end of the supporting portion 51*b*. An energizing circuit 56 may be connected to the electromagnet 54. When being energized by the energizing circuit 56, i.e., when electric current is caused to flow therethrough by the energizing circuit 56, the electromagnet 54, as an example of the release member, may generate a magnetic force between the permanent magnet 46 of the light blocking panel 31*c* and the metal piece 45 of the case 30, such that the permanent magnet 46 and the metal piece 45 separate away from each other, and thereby may release the light blocking panel 31*c* from a fixed state in which the light blocking panel 31*c* is fixed to the case 30.

Figure 3B:
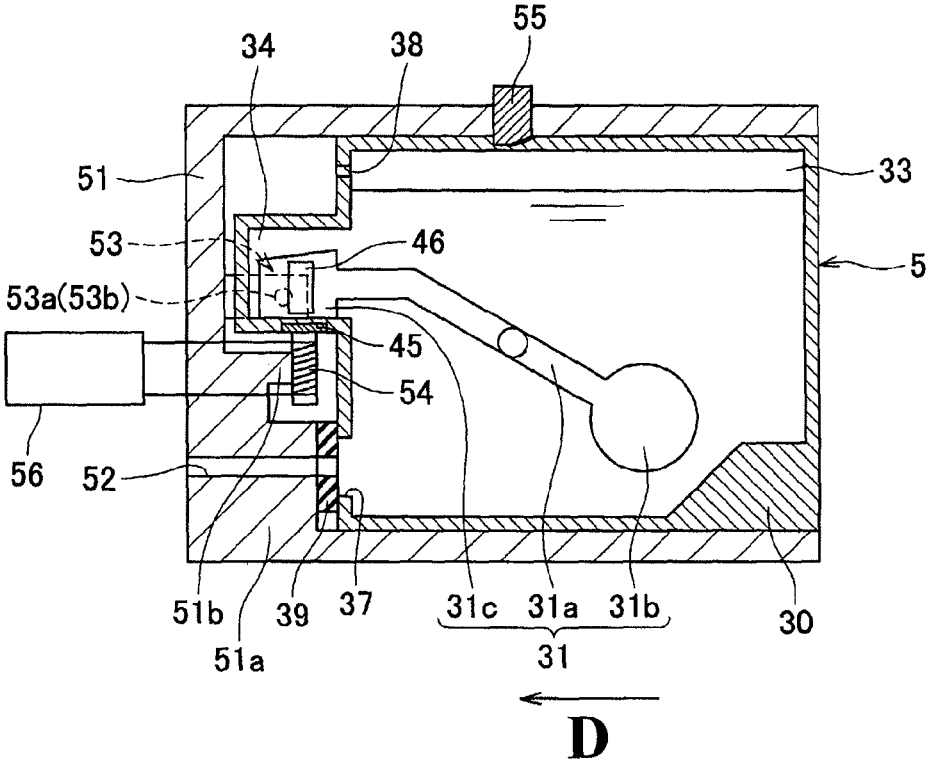
FIG. 3(B) is a cross-sectional view of the holder and the ink cartridge of FIG. 2 in which the ink cartridge is mounted to the cartridge mounting portion.

Referring to FIG. 3(B), when the ink cartridge 5 is mounted to the cartridge mounting portion 7, the case 30 may come into contact with the protruding portion 51*a* of the front wall 51 via the sealing member 39. When this occurs, the ink supply channel 52 formed through the protruding portion 51*a* and the ink supply opening 37 formed in the case 30 may become in fluid communication with each other. The air communication opening 38 formed in the case 30 may have been opened, and consequently, air may be introduced from the outside of the case 30 via air communication opening 38 into the ink chamber 33 while the ink in the ink chamber 33 is supplied via the ink supply opening 37 into the ink supply channel 52 of the cartridge mounting portion 7.

Moreover, the projecting portion 35 of the case 30 may be inserted between the light-emitting portion 53*a* and the light-receiving portion 53*b* of the optical sensor 53. The light blocking panel 31*c* of the pivotable member 31 may be fixed to the case 30 in the lower end position where the light blocking panel 31*c* contacts the bottom surface of the sensor chamber 34 by the magnetic force acting between the permanent magnet 46 of the light blocking panel 31*c* and the metal piece 45 provided at the projecting portion 35. In addition, the optical sensor 53 may be positioned, such that the light emitted from the light-emitting portion 53*a* is blocked by the light blocking panel 31*c* when the light blocking panel 31*c* is in the lower end position. Therefore, when the ink cartridge 5 is mounted to the cartridge mounting portion 7 in a state in which the light blocking panel 31*c* is fixed in the lower end position, the light emitted from the light-emitting portion 53*a* of the optical sensor 53 may be blocked by the light blocking panel 31*c*, and therefore the optical sensor 53 can detect that the ink cartridge 5 is mounted to the cartridge mounting portion 7. In other words, the optical sensor 53 may be an example of the mount detector.

The electromagnet 54 may be configured to release the light blocking panel 31*c* from the fixed state temporarily by generating the magnetic force between the metal piece 45 and the permanent magnet 46, such that the metal piece 45 and the permanent magnet 46 separates away from each other, when it is detected that the ink cartridge 5 is mounted to the cartridge mounting portion 7 by the optical sensor 53. With the electromagnet 54, it can be determined whether or not a predetermined amount or more of ink is stored in the ink chamber 33 as described in detail later.

Figure 4:
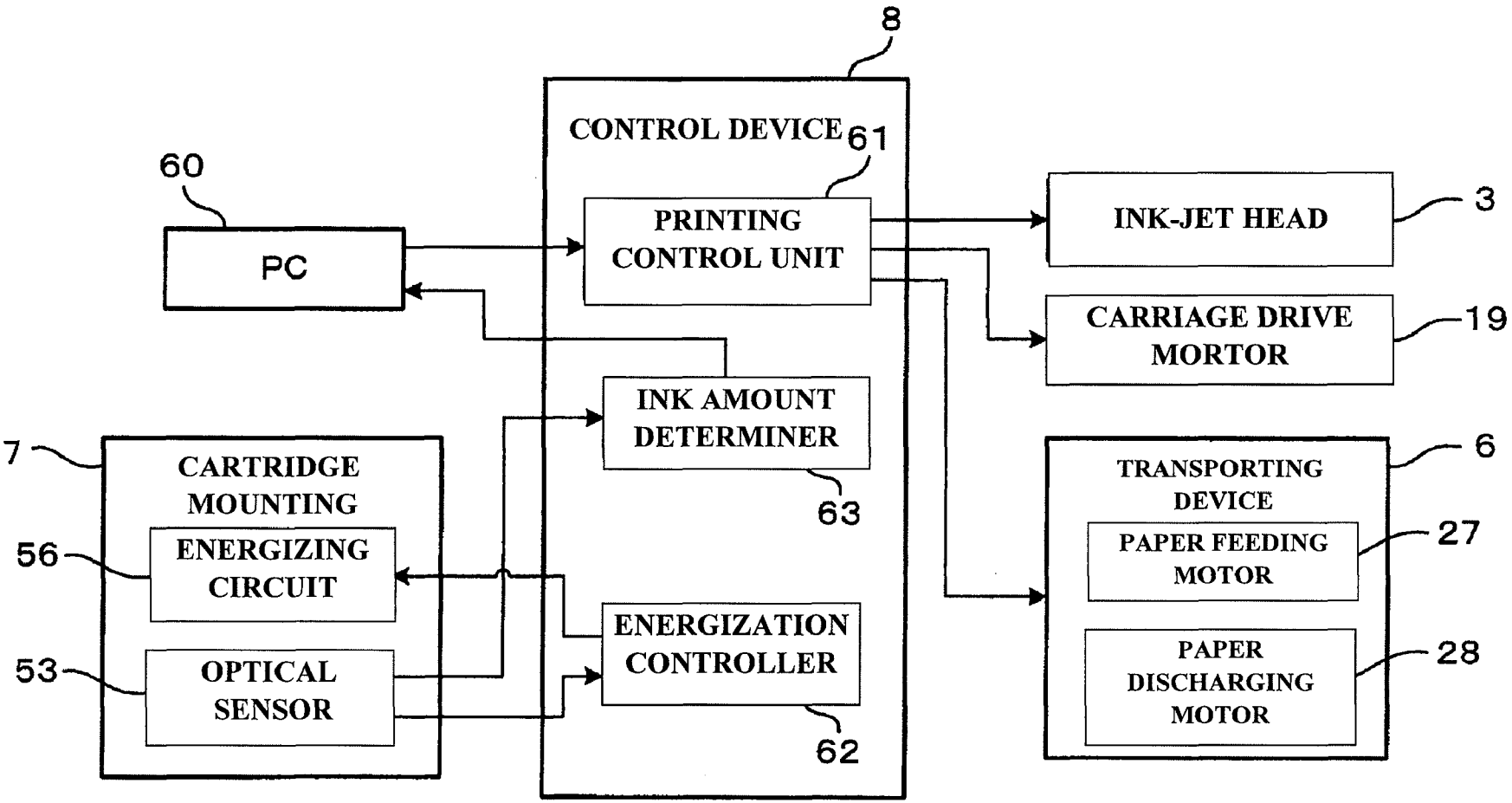
FIG. 4 is a block diagram of an electric configuration of the ink jet printer.

Referring to FIG. 4, a control device 8 of the printer 1 may comprise a CPU (Central Processing Unit), a ROM (Read Only Memory) in which various programs or data for controlling the general movement of the printer 1 is stored, and a RAM (Random Access Memory) for storing the data or the like processed in the CPU temporarily. The control device 8 may be configured to perform various procedures such as a procedure as described below by the programs stored in the ROM being executed by the CPU. In another embodiment, the control device 8 may be realized by a hardware comprising various circuits including calculating circuits.

A printing control unit 61 of the control device 8 may be configured to control the ink jet head 3, the carriage drive motor 19 configured to drive the carriage 2, the paper feeding motor 27, and the paper discharging motor 28 of the transporting device 6 and to print a desired image or the like on the sheet of paper P on the basis of data relating to the printing image input from a PC 60.

The control device 8 may comprises an energization controller 62 configured to control the energizing circuit 56 which energizes the electromagnet 54, i.e., causes electric current to flow through the electromagnet 54. The control device 8 also may comprise an ink amount determiner 63 configured to determine whether or not a predetermined amount or more of ink is stored in the ink cartridge 5 on the basis of an output signal of the optical sensor 53 when the energizing circuit 56 energizes the electromagnet 54.

In the printer 1 of this embodiment, even when the ink cartridge 5 is mounted to the cartridge mounting portion 7, if the electromagnet 54 is not energized by the energizing circuit 56, the light blocking panel 31*c* may be maintained in the fixed state in the lower end position by the magnetic force acting between the metal piece 45 and the permanent magnet 46. Even when the ink stored in the case 30 decreases while the ink-jet head 3 consumes the ink, the light blocking panel 31*c* may not move upward unless the electromagnet 54 is energized.

The printer 1 of this embodiment may be configured to cause the energizing circuit 56 to instantaneously energize the electromagnet 54 immediately after the mounting of the ink cartridge 5 to the cartridge mounting portion 7 is completed, or immediately after the printer 1 becomes turned on, such that the light blocking panel 31*c* is released from the fixed state temporarily. By the optical sensor 53 detecting the movement of the light blocking panel 31*c* when the light blocking panel 31*c* is released, it can be determined whether or not a predetermined amount or more of ink is stored in the ink chamber 33. Moreover, the printer 1 may be configured to cause the energizing circuit 56 to instantaneously energize the electromagnet 54, such that the light blocking panel 31*c* is released from the fixed state temporarily, at predetermined timings after it is determined that the predetermined amount or more of ink is stored in the ink chamber 33. Thereby, it can be determined whether or not the predetermined amount or more of ink is stored in the ink chamber 33 at the predetermined timings. More specifically, when the light blocking panel 31*c* is released from the fixed state, the light blocking panel 31*c* may move up and down in the sensor chamber 34 in association with the upward and downward movement of the float 31*b* according to the amount of ink stored in the case 30, and the movement of the light blocking panel 31*c* may depend on the amount of ink stored in the case 30. By the optical sensor 53 detecting the movement of the light blocking panel 31*c* when the light blocking panel 31*c* is released from the fixed state, it can be determined whether or not a predetermined amount or more of ink is stored in the ink chamber 33.

The energization controller 62 may cause the energizing circuit 56 to energize the electromagnet 54 at the predetermined timings after it is detected that the mounting of the ink cartridge 5 to the cartridge mounting portion 7 is completed by the optical sensor 53 as the mount detector. Accordingly, the magnetic force between the permanent magnet 46 of the light blocking panel 31*c* and the metal piece 45 of the case 30 to separate the permanent magnet 46 and the metal piece 45 away from each other may be generated and the light blocking panel 31*c* may be released from the fixed state. The ink amount determiner 63 as an example of the first determiner may determine whether or not the predetermined amount or more of ink is stored in the ink chamber 33 on the basis of the movement (position) of the light blocking panel 31*c* detected by the optical sensor 53 when the light blocking panel 31*c* is released from the fixed state.

Figure 5A:
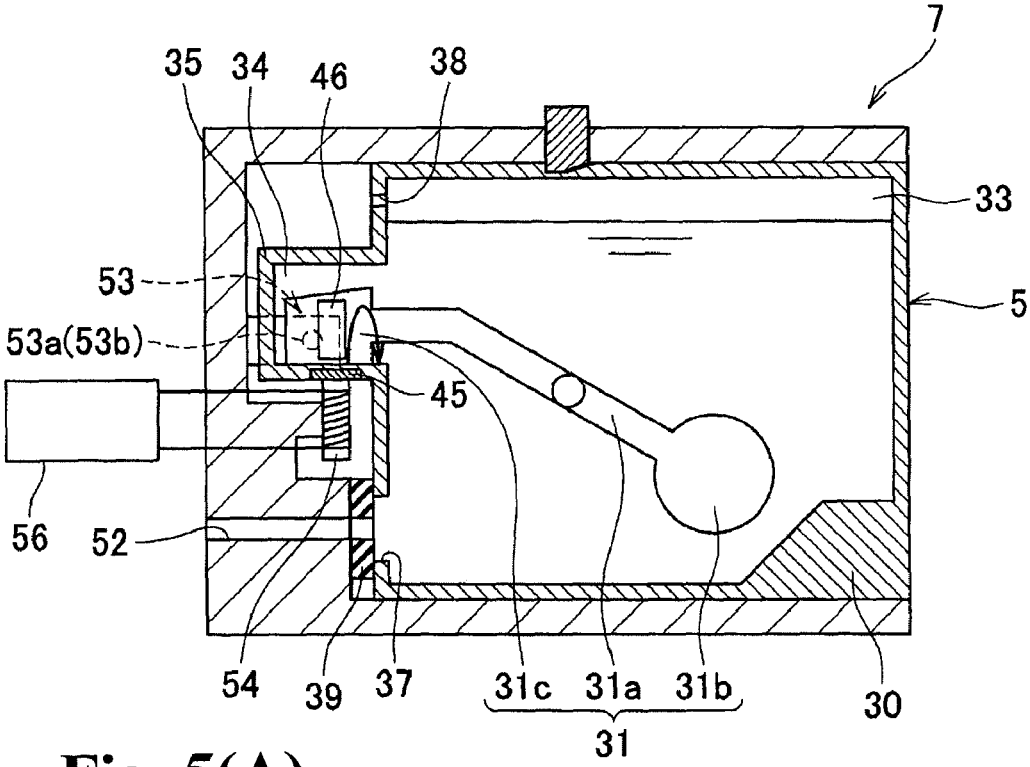
FIGS. 5(A) and 5(B) are cross-sectional views of the holder and the ink cartridge of FIG. 3(B), in which the ink cartridge has a sufficient amount of ink stored therein in FIG. 5(A), and the ink cartridge has little amount of ink stored therein in FIG. 5(B).
Figure 5B:
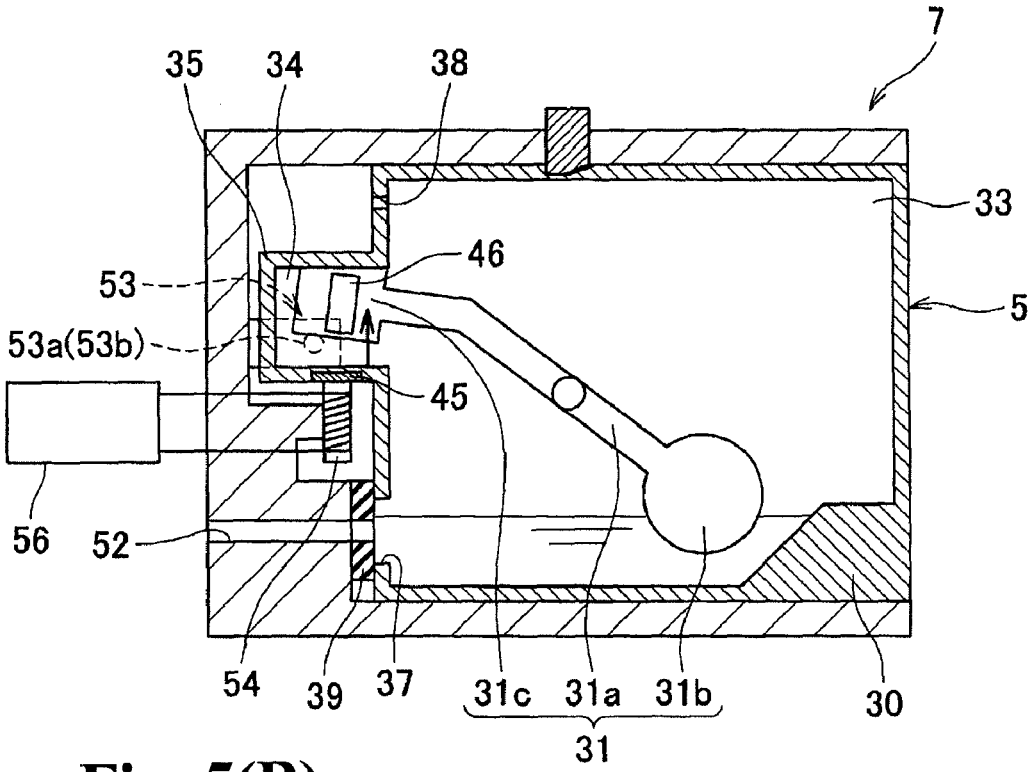

FIGS. 5(A) and 5(B) show the movement of the light blocking panel 31*c* when the light blocking panel 31*c* is released from the fixed state, in which the ink cartridge 5 has a sufficient amount of ink stored therein in FIG. 5(A), and the ink cartridge 5 has little amount of ink stored therein in FIG. 5(B). Referring to FIG. 5(A), when the light blocking panel 31*c* is released from the fixed state by instantaneously energizing the electromagnet 54 in a case where the amount of ink in the ink chamber 33 is sufficient, the light blocking panel 31*c* may move upward once from the lower end position by the magnetic force generated by the electromagnet 54, but may quickly move back to the lower end position in association with upward movement of the float 31*b* with the aid of the buoyancy and may be fixed relative to the case 30 again in the lower end position, as indicated by a thick arrow in the drawing. When this occurs, the light emitted from the light-emitting portion 53*a* of the optical sensor 53 may be received once by the light-receiving portion 53*b* when the light blocking panel 31*c* moves upward, but may quickly become blocked by the light blocking panel 31*c* again. In other words, the output from the optical sensor 53 may change from ON (light is blocked) via OFF (light is not blocked) to ON (light is blocked).

In contrast, referring to FIG. 5(B), when the light blocking panel 31*c* is released from the fixed state by instantaneously energizing the electromagnet 54 in a case where little amount of ink is stored in the ink chamber 33, the light blocking panel 31*c* may move upward from the lower end position by the magnetic force generated by the electromagnet 54 as indicated by a thick arrow in the drawing. In addition, the float 31*b* may move downward because the buoyancy acting on the float 31*b* is small, and therefore the light blocking panel 31*c* may reach the upper end position of the movable range of the light blocking panel 31*c*, i.e., in a position where the light blocking panel 31*c* contacts the top surface of the sensor chamber 34. In this state, the magnetic force for the metal piece 45 and the permanent magnet 46 to attract each other may becomes very small, and therefore the light blocking panel 31*c* may not return to the lower end position. When this occurs, the light emitted from the light-emitting portion 53*a* of the optical sensor 53 may not be blocked by the light blocking panel 31*c* and may be received by the light-receiving portion 53*b*. In other words, the output from the optical sensor 53 may change from ON (light is blocked) to OFF (light is not blocked).

As described above, because the movement of the light blocking panel 31*c* when the light blocking panel 31*c* is released from the fixed state may depend on the ink amount stored in the ink chamber 33, the ink amount determiner 63 can determine whether or not the predetermined amount or more of ink is stored in the case 30 on the basis of the output signal from the optical sensor 53 for detecting the movement of the light blocking panel 31*c*. In this embodiment, the optical sensor 53 may serve not only as the mount detector for detecting the mount of the ink cartridge 5, but also as the first movement detector for detecting the movement of the light blocking panel 31*c*.

The light blocking panel 31*c* may be released at arbitrary timings by the energization controller 62 causing the energizing circuit 56 to energize the electromagnet 54. In other words, the determination of the ink amount on the basis of the detected movement of the light blocking panel 31*c* when the light blocking panel 31*c* is released may be performed at any timing as long as it is detected that the ink cartridge 5 is mounted to the cartridge mounting portion 7. For example, it may be performed immediately after the printer 1 becomes turned on or when a command relating to the printing of the image or the like is inputted from the PC 60.

As described above, the light blocking panel 31*c* may be fixed to the case 30 at the lower end position almost all the time other than the time when the electromagnet 54 is energized for determining whether or not the predetermined amount or more of ink is stored in the case 30. Therefore, even if the ink cartridge 5 vibrates when the printer 1 performs printing, the pivotable member 31 may be prevented from pivoting and the formation of bubbles in the ink chamber 33 due to the movement of the pivotable member 31 may be prevented. When the light blocking panel 31*c* is fixed in the lower end position, the optical sensor 53 can be set in a waiting state in which the light-emitting portion 53*a* does not emit light, and the optical sensor 53 can be brought into an operating state in which the light-emitting portion 53*a* emits light only when the light blocking panel 31*c* is released for determining whether or not the predetermined amount or more of ink is stored in the case 30. In such a case, because the optical sensor 53 needs to be operated for a short period of time, the power consumption can be reduced.

In the printer 1 in this embodiment described above, because the pivotable member 31 is fixed to the case 30 by the magnetic force acting between the pair of magnetic materials (the permanent magnet 46 and the metal piece 45) provided respectively to the light blocking panel 31*c* of the pivotable member 31 and the case 30 when the ink cartridge 5 is not mounted to the cartridge mounting portion 7, the pivotable member 31 may be prevented from pivoting and the light blocking panel 31*c* may be prevented from moving up and down even if the ink surface in the case 30 fluctuates. Therefore, the damage of the pivotable member 31 and the case 30 or generation of noise can be prevented.

If the pivotable member 31 pivots before the ink cartridge 5 is mounted to the cartridge mounting portion 7, bubbles may be formed in the ink, and if the ink cartridge 5 is mounted to the cartridge mounting portion 7 with such bubbles formed therein, the movement of the pivotable member 31 may be impaired by the bubbles. However, in this embodiment, formation of the bubbles can be prevented by fixing the pivotable member 31 so as not to pivot.

Moreover, the light blocking panel 31*c* may be released from the fixed state when the electromagnet 54 is energized to generate the magnetic force acting between the permanent magnet 46 of the light blocking panel 31*c* and the metal piece 45 of the case 30, such that the permanent magnet 46 and the metal piece 45 separates away from each other after the mounting of the ink cartridge 5 to the cartridge mounting portion 7 is completed. Because the magnetic force is used for releasing the light blocking panel 31*c*, damage caused by an external force applied to the light blocking panel 31*c* when the light blocking panel 31*c* is released may be avoided.

Magnetic materials provided respectively to a light blocking panel and a case may not be limited to those used in the embodiment described above as long as they generate a magnetic force for attracting each other. For example, in another embodiment, a metal piece may be provided to a light blocking panel and a permanent magnet may be provided to a case. Alternatively, permanent magnets may be provided to both a light blocking panel and a case. When the permanent magnet is provided to a case, the magnetic field generated by the permanent magnet by itself cannot be changed by the electromagnet. However, by shifting the horizontal positions of the permanent magnet and the electromagnet, the magnetic force acting between the permanent magnet and the metal piece of the light blocking panel for them to attract each other can be weakened by the magnetic field generated by the electromagnet, such that the light blocking panel can be released from the fixed state. Also, the magnetic material may not have to be a metal piece, and may be ceramics or the like as long as they generate a magnetic force for them to attract each other.

Figure 6:
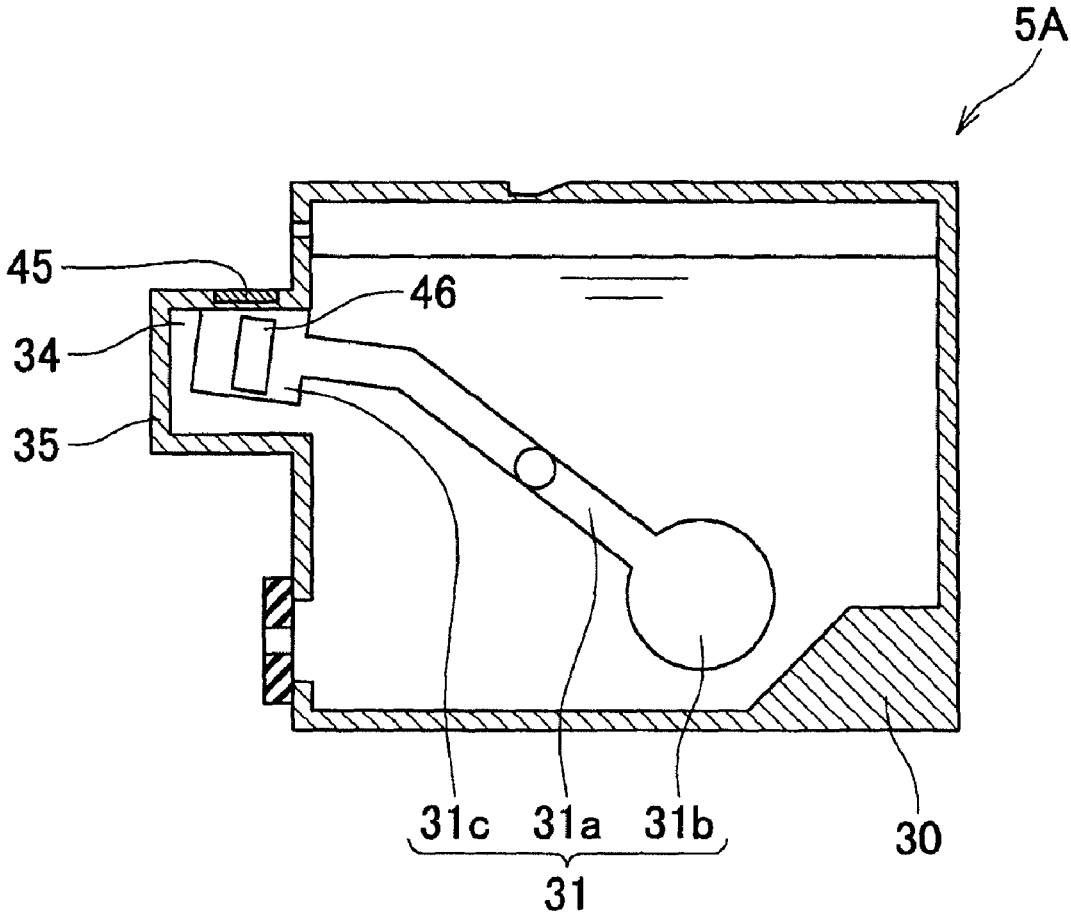
FIG. 6 is a cross-sectional view of an ink cartridge according to another embodiment of the present invention.

Referring to FIG. 6, in another embodiment, in an ink cartridge 5A, the metal piece 45 may be provided at an upper wall of the projecting portion 35 which defines the top surface of the sensor chamber 34, and the light blocking panel 31*c* may be fixed in the upper end position of the movable range of the light blocking panel 31*c*, i.e., in a position where the light blocking panel 31*c* contacts the top surface of the sensor chamber 34 when the amount of ink in the ink chamber 33 is small.

Figure 7A:
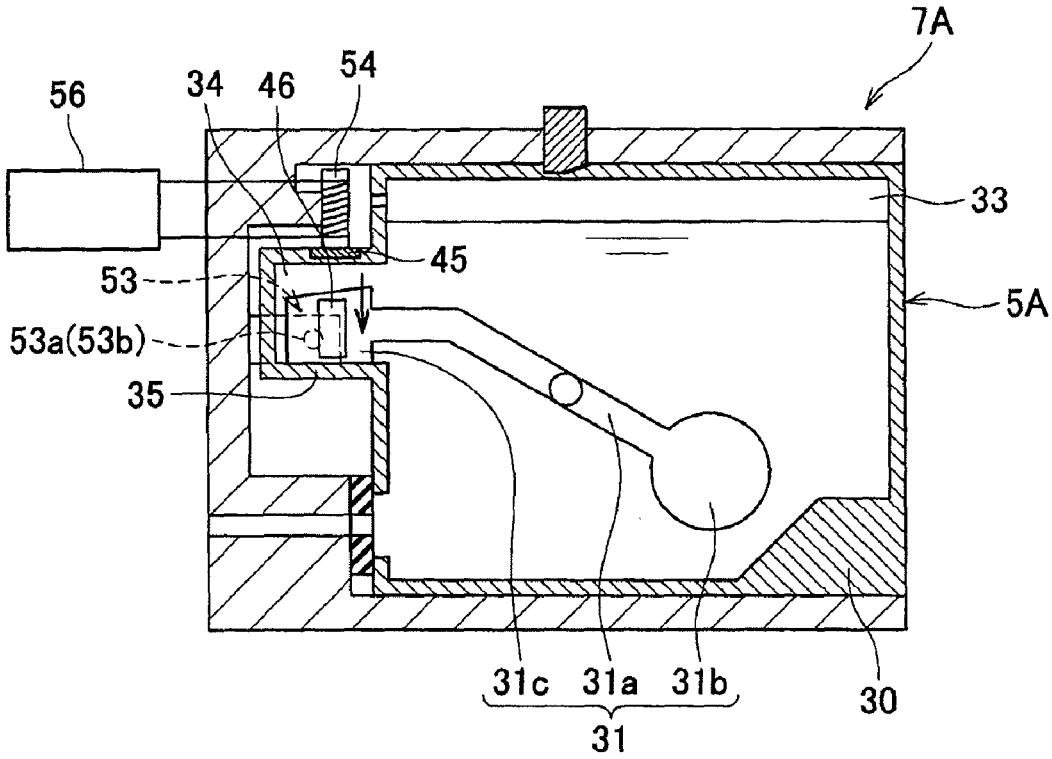
FIGS. 7(A) and 7(B) are cross-sectional views of a holder and the ink cartridge of FIG. 6 mounted to a cartridge mounting portion of the holder, in which the ink cartridge has a sufficient amount of ink stored therein in FIG. 7(A), and the ink cartridge has little amount of ink stored therein in FIG. 7(B).

In this embodiment, the movement of the light blocking panel 31*c* when the light blocking panel 31*c* is released from the fixed state by the electromagnet 54 of a cartridge mounting portion 7A may be different from the movement of the light blocking panel 31*c* of the embodiment described above. Referring to FIG. 7(A), when the light blocking panel 31*c* is released from the fixed state by instantaneously energizing the electromagnet 54 in a case where the amount of ink in the ink chamber 33 is sufficient, the light blocking panel 31*c* may move downward from the upper end position by the magnetic force generated by the electromagnet 54 as shown by a thick arrow in the drawing. Moreover, the light blocking panel 31*c* may move downward in association with the upward movement of the float 31*b* on which the buoyancy acts, such that the light blocking panel 31*c* reaches the lower end position where the light blocking panel 31*c* contacts the bottom surface of the sensor chamber 34. In this state, because the magnetic force for the metal piece 45 and the permanent magnet 46 to attract each other has become small, the light blocking panel 31*c* may not return to the upper end position.

Figure 7B:
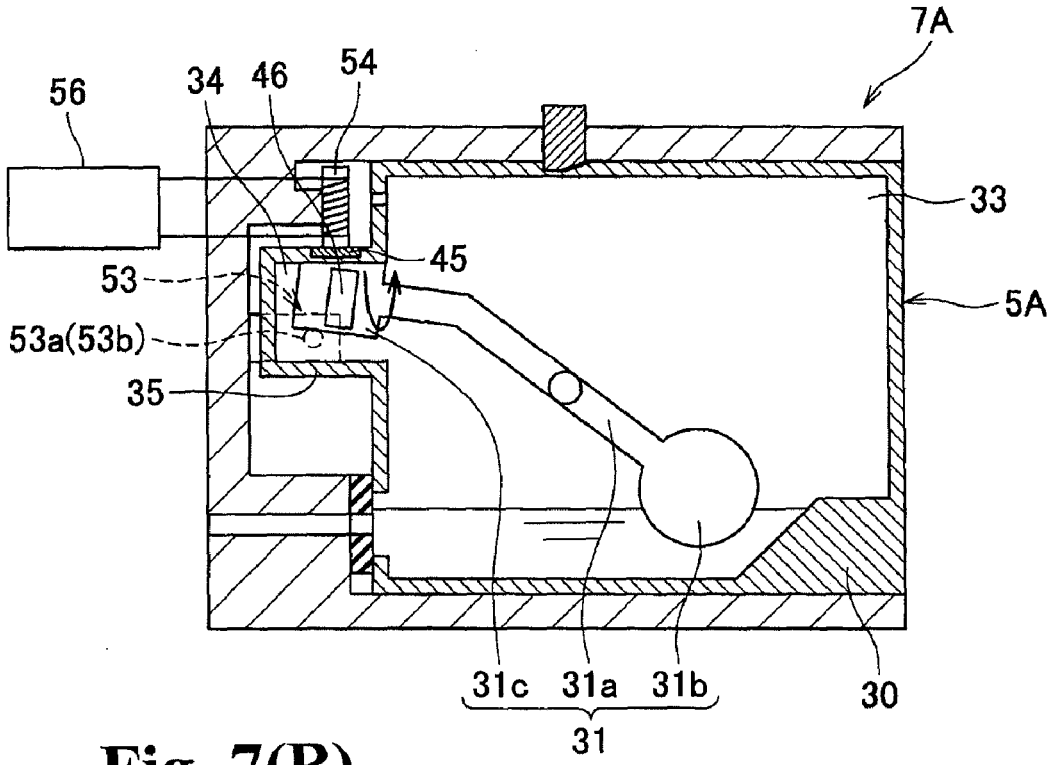
Figure 8:
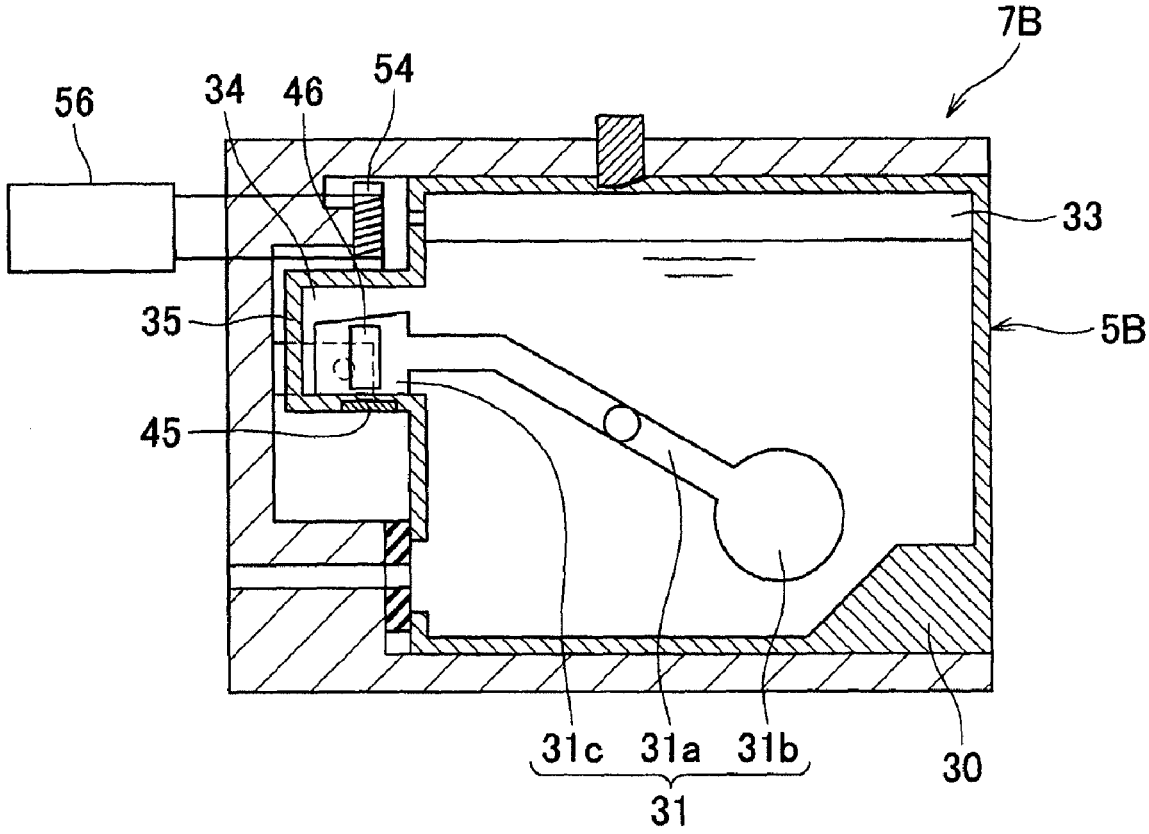
FIG. 8 is a cross-sectional view of a holder and an ink cartridge mounted to a cartridge mounting portion of the holder according to yet another embodiment of the present invention.
Figure 9:
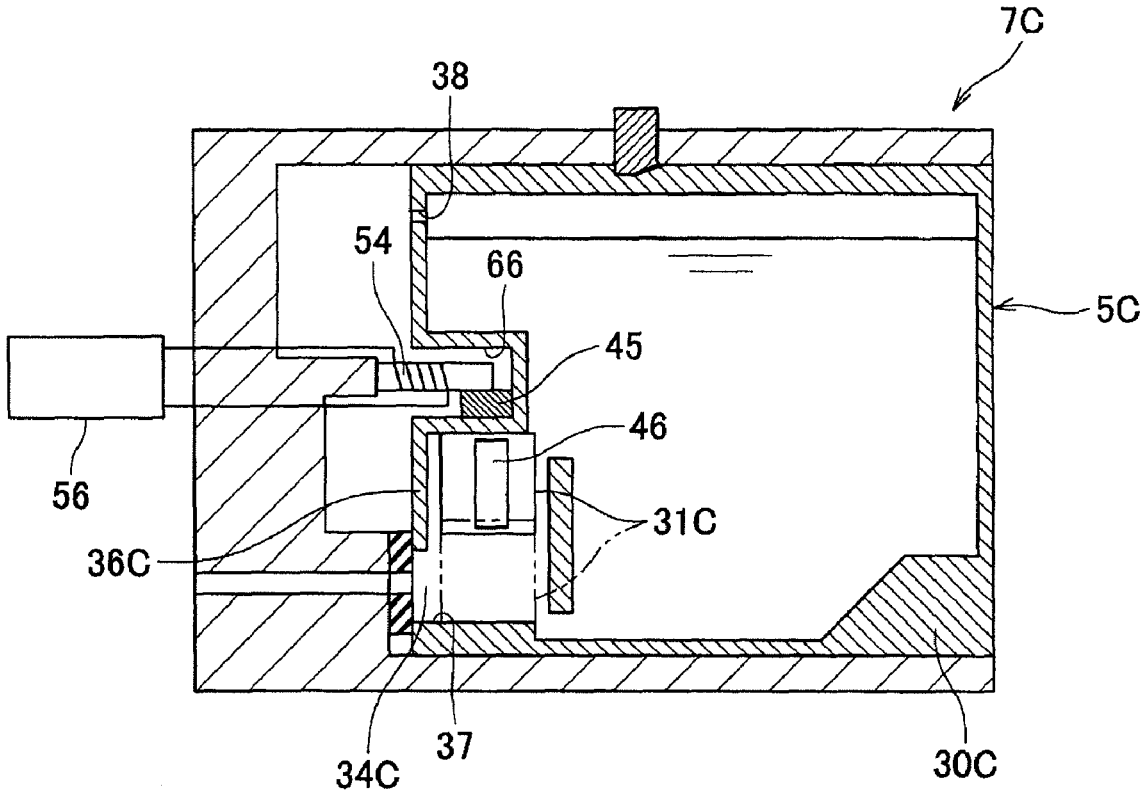
FIG. 9 is a cross-sectional view of a holder and an ink cartridge mounted to a cartridge mounting portion of the holder according to still another embodiment of the present invention.

In contrast, referring to FIG. 7(B), when the light blocking panel 31*c* is released from the fixed state by instantaneously energizing the electromagnet 54 in a case where little amount of ink is stored in the ink chamber 33, the light blocking panel 31*c* may move downward once from the upper end position by the magnetic force generated by the electromagnet 54. However, the float 31*b* may move downward because the buoyancy acting on the float 31*b* is small, and therefore the light blocking panel 31*c* may quickly move back to the upper end position and may be fixed again in the upper end position, as shown by a thick arrow in the drawing.

In this manner, the movement of the light blocking panel 31*c* when the light blocking panel 31*c* is released from the fixed state may depend on the ink amount, and therefore, the ink amount determiner 63 can determine whether or not a predetermined amount or more of ink is stored in the case 30 on the basis of the output signal from the optical sensor 53 detecting the movement of the light blocking panel 31*c*.

In this embodiment, as described above, when the amount of ink in the case 30 is sufficient, the light blocking panel 31*c* may hardly be affected by the magnetic force after the light blocking panel 31*c* has reached the lower end position, and hence the light blocking panel 31*c* may move according to the amount of ink in the case 30 thereafter. In other words, even when the energization of the electromagnet 54 is stopped after the light blocking panel 31*c* is released from the fixed state, the light blocking panel 31*c* may not return to and be fixed by the magnetic force in the upper end position until the amount of ink decreases to a little amount. Light may be emitted constantly from the light-emitting portion 53*a* of the optical sensor 53, and whether or not the light is blocked by the light blocking panel 31*c* is constantly detected, such that whether or not the predetermined amount or more of ink is stored in the case 30 can be constantly determined.

In this embodiment, the optical sensor 53 may be an example of the second movement detector configured to detect the downward movement of the light blocking panel 31*c* when the light blocking panel 31*c* is released, and the ink amount determiner 63 may be an example of the second determiner configured to determine whether or not a predetermined amount or more of ink is stored in the case 30 on the basis of the result of detection of the optical sensor 53.

A magnetic material provided to the case and an electromagnet of the cartridge mounting portion may not have to be positioned on the same side with respect to the light blocking panel 31*c*, and may be positioned on the both sides of the light blocking panel 31*c*, respectively, sandwiching the light blocking panel 31*c*. For example, referring to FIG. 8, in another embodiment, in an ink cartridge 5B, the metal piece 45 may be provided at the bottom wall of the projecting portion 35 which forms the bottom surface of the sensor chamber 34, and the light blocking panel 31*c* may be fixed to the lower end position where the light blocking panel 31*c* contacts the bottom surface of the sensor chamber 34. In a cartridge mounting portion 7B, the electromagnet 54 may be provided at a position above the upper wall of the projecting portion 35 which forms the top surface of the sensor chamber 34. In this configuration, when the energizing circuit 56 energizes the electromagnet 54, a magnetic force acts between the electromagnet 54 and the permanent magnet 46 of the light blocking panel 31*c*, such that the electromagnet 54 and the permanent magnet 46 attract each other, i.e., such that the metal piece 45 of a case 30 and the permanent magnet 46 of the light blocking panel 31*c* separates away from each other. As a result, the light blocking panel 31*c* may be pulled upward and the light blocking panel 31*c* may be released from the fixed state. In another embodiment, the metal piece 45 of the case 30 may be provided at the upper wall of the projecting portion and the electromagnet 54 of the cartridge mounting portion 7B may be provided below the bottom wall of the projecting portion.

As a movable member configured to move according to an amount of ink stored in a case may be a float by itself. For example, referring to FIG. 9, in another embodiment, an ink cartridge 5C may comprise the ink supply opening 37 and the air communication opening 38 formed through a front wall 36C of a case 30C, and a depressed portion 66 may be formed between the ink supply opening 37 and the air communication opening 38, and a sensor chamber 34C may be formed below the depressed portion 66. A light blocking panel 31C formed of the float may be disposed in the sensor chamber 34C so as to be movable upward and downward between a position indicated by a solid line and a position indicated by a double dashed line in the drawing according to the change of the ink amount. The metal piece 45 may be provided inside the depressed portion 66 of the case 30C and a magnetic force may act between the metal piece 45 and the permanent magnet 46 of the light blocking panel 31C, such that the metal piece 45 and the permanent magnet 46 attract each other. Therefore, the light blocking panel 31C formed of the float may be attracted upward by the metal piece 45 provided at the case 30C, and may be fixed to the case 30C, contacting a top surface of the sensor chamber 34C, which is positioned below the depressed portion 66.

The electromagnet 54 may be provided in a cartridge mounting portion 7C. When the ink cartridge 5C is mounted to the cartridge mounting portion 7C, the electromagnet 54 may be inserted into the depressed portion 66 of the case 30C, and may be positioned directly above the metal piece 45.

Then, when the energizing circuit 56 energizes the electromagnet 54, the electromagnet 54 may generate a magnetic force which acts between the metal piece 45 and the permanent magnet 46, such that the metal piece 45 and the permanent magnet 46 separate away from each other. As a result, the light blocking panel 31C formed of the float may be released from the fixed state.

A release member configured to release a movable member from the fixed state by generating a magnetic force between a pair of magnetic materials for them to separate from each other may not be limited to an electromagnet which generates a magnetic force when being energized. For example, in another embodiment, a permanent magnet which is movable with respect to an ink cartridge mounted to a cartridge mounting portion may be provided in the cartridge mounting portion. When the permanent magnet may move close the ink cartridge, a magnetic force may be generated between the pair of magnetic materials of the ink cartridge, such that they separate away from each other.

In the embodiment described above, the single optical sensor may function as the mount detector configured to detect that the ink cartridge is mounted to the cartridge mounting portion and the movement detector configured to detect the movement of the light blocking panel. However, the mount detector and the movement detector may be provided as separate sensors. For example, in another embodiment, the movement detector may be an optical sensor, and the mount detector may be a proximity sensor or a limit switch.

A movable member configured to move according to an amount of liquid stored in a case may not be limited to a light blocking panel whose position is detected by a optical sensor having a light-emitting portion and a light-receiving portion. For example, in another embodiment, a movable member may be connected to a float positioned in a case storing liquid and may move outside the case in association with the upward and downward movement of the float. In this case, because the position of the movable member moving outside the case can be detected by sensors other than the optical sensor such as a proximity sensor or a limit switch provided at a cartridge mounting portion, the movable member may not have to be configured as a light blocking panel.

Although the embodiments described above are examples in which the present invention is applied to the ink cartridge used in the ink jet printer, the present invention may be applied irrespective of the usage or the type of liquid stored in a liquid cartridge.

While the invention has been described in connection with various exemplary structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. A liquid supply apparatus comprising:

a container mounting portion; and a liquid container configured to be removably mounted to the container mounting portion, the liquid container comprising:

a case configured to store liquid therein; and a movable member positioned in the case and configured to move relative to the case according to an amount of liquid stored in the case, wherein the movable member and the case comprise a pair of magnetic materials on which a magnetic force acts, such that the pair of magnetic materials attracts each other, when the liquid container is not mounted to the container mounting portion, the movable member is in a fixed state in which the movable member is fixed to the case by the magnetic force acting between the pair of magnetic materials, and the container mounting portion comprises a release member configured to release the movable member from the fixed state by generating a magnetic force acting between the pair of magnetic materials, such that the pair of magnetic materials separates away from each other, when the liquid container is mounted to the container mounting portion.

2. The liquid supply apparatus according to claim 1, wherein the release member comprises an electromagnet configured to generate the magnetic force when being energized, such that the pair of magnetic materials separates away from each other, and the liquid supply apparatus further comprises a controller configured to control energization of the electromagnet.

3. The liquid supply apparatus according to claim 2, further comprising a mount detector configured to detect that the liquid container is mounted to the container mounting portion, wherein the controller is configured to energize the electromagnet when it is detected by the mount detector that the liquid container is mounted to the container mounting portion.

4. The liquid supply apparatus according to claim 3, wherein the movable member is configured to move in a first direction when the movable member is released from the fixed state and the amount of liquid stored in the case decreases, and the movable member is fixed to the case by the magnetic force acting between the pair of magnetic materials in an end position of a movable range of the movable member in the first direction.

5. The liquid supply apparatus according to claim 4, further comprising:

a first movement detector configured to detect the movement of the movable member when it is detected by the mount detector that the liquid container is mounted to the container mounting portion and the movable member is released from the fixed state by the controller energizing the electromagnet; and a first determiner configured to determine whether or not a predetermined amount or more of liquid is stored in the case, based on result of detection by the first movement detector.

6. The liquid supply apparatus according to claim 3, wherein the movable member is configured to move in a first direction when the movable member is released from the fixed state and the amount of liquid stored in the case decreases, and the movable member is fixed to the case by the magnetic force acting between the pair of magnetic materials in an end position of a movable range of the movable member in a second direction opposite to the first direction.

7. The liquid supply apparatus according to claim 6, wherein the controller is configured to energize the electromagnet, such that the movable member is temporarily released from the fixed state, when it is detected by the mount detector that the liquid cartridge is mounted to the container mounting portion, and the liquid supply apparatus further comprises: a second movement detector configured to detect the movement of the movable member when the movable member is temporarily released from the fixed state; and a second determiner configured to determine whether or not a predetermined amount or more of liquid is stored in the case, based on result of detection by the second movement detector.

8. The liquid supply apparatus according to claim 1, wherein the movable member comprises a float configured to move according to a change of a liquid level in the case when the movable member is released from the fixed state.

9. The liquid supply apparatus according to claims 1, wherein the liquid container further comprises a float positioned in the case and configured to move according to a change of a liquid level in the case, and an arm connected at a first end thereof to the float and configured to pivot relative to the case, and the movable member is connected to a second end of the arm opposite the first end, such that the movable member moves relative to the case in response to a movement of the float when the movable member is released from the fixed state.

10. A liquid container, comprising:

a case configured to store liquid therein; and a movable member positioned in the case and configured to move relative to the case according to an amount of liquid stored in the case, wherein the movable member and the case comprise a pair of magnetic materials on which a magnetic force acts, such that the pair of magnetic materials attracts each other, wherein the movable member is in a fixed state in which the movable member is fixed to the case by the magnetic force acting between the pair of magnetic materials, wherein the movable member is configured to move in a first direction when the amount of liquid stored in the case decreases, and wherein the movable member is in the fixed state in which the movable member is fixed to the case by the magnetic force acting between the pair of magnetic materials in an end position of a movable range of the movable member in a second direction opposite to the first direction.

* * * * *